US008451290B2

(12) United States Patent
Jang et al.

(10) Patent No.: US 8,451,290 B2
(45) Date of Patent: May 28, 2013

(54) APPARATUS AND METHOD FOR CONVERTING COLOR OF AN IMAGE

(75) Inventors: Hye On Jang, Seongnam-si (KR); Byung Il Koh, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1131 days.

(21) Appl. No.: 12/104,485

(22) Filed: Apr. 17, 2008

(65) Prior Publication Data

US 2009/0141040 A1 Jun. 4, 2009

(30) Foreign Application Priority Data

Dec. 3, 2007 (KR) ..... 10-2007-0124582

(51) Int. Cl.
*G09G 5/02* (2006.01)

(52) U.S. Cl.
USPC ..... 345/603; 345/419

(58) Field of Classification Search
USPC ..... 345/603, 419
See application file for complete search history.

(56) References Cited

U.S. PATENT DOCUMENTS

| | | | | |
|---|---|---|---|---|
| 5,982,382 | A * | 11/1999 | Benzel | 345/661 |
| 6,873,730 | B2 | 3/2005 | Chen et al. | |
| 7,123,263 | B2 | 10/2006 | Harvill et al. | |
| 2005/0270302 | A1 * | 12/2005 | Weast | 345/590 |
| 2005/0285853 | A1 | 12/2005 | Morita et al. | |
| 2006/0294465 | A1 * | 12/2006 | Ronen et al. | 715/706 |
| 2008/0052242 | A1 * | 2/2008 | Merritt et al. | 705/59 |
| 2009/0094517 | A1 * | 4/2009 | Brody et al. | 715/706 |

FOREIGN PATENT DOCUMENTS

| | | | |
|---|---|---|---|
| JP | 2004-030402 | | 1/2004 |
| JP | 2005-176202 | | 6/2005 |
| JP | 2005-322085 | | 11/2005 |
| JP | 2007-094840 | A | 4/2007 |
| KR | 1020060093821 | A | 6/2006 |
| KR | 1020070033189 | A | 3/2007 |
| KR | 1020070084277 | A | 8/2007 |

* cited by examiner

*Primary Examiner* — Maurice L McDowell, Jr.
(74) *Attorney, Agent, or Firm* — NSIP Law

(57) ABSTRACT

An apparatus for converting a color of an image includes an object region determination unit to determine a 3D object display region in an input image, a color gamut determination unit to determine whether a color of a pixel that constitutes the 3D object display region is included in a predetermined color gamut, a user preference information receiver to receive user preference information corresponding to the input image, and a color converter to convert the color of a pixel to an output color based on the user preference information.

19 Claims, 4 Drawing Sheets

APPARATUS AND METHOD FOR CONVERTING COLOR OF AN IMAGE

CROSS-REFERENCE TO RELATED APPLICATION

This application claims the benefit under 35 U.S.C. §119 (a) of Korean Patent Application No. 10-2007-0124582, filed on Dec. 3, 2007, in the Korean Intellectual Property Office, the entire disclosure of which is incorporated herein by reference.

TECHNICAL FIELD

The following description relates to image display devices, and more particularly, to apparatuses and methods for converting a color of an image.

BACKGROUND

With the developments of computer technologies, media using computer graphics are gradually increasing.

In the media using computer graphics, a three dimensional (3D) game or a computer animation constitutes a thing, a character, a building, and the like, which is represented in an image, using a 3D object. A display processing apparatus of the 3D game or a 3D engine embodying the computer animation determines a color of the 3D object based on an inherent color and a light source of the 3D object.

The color of the 3D object that is determined by the 3D engine may be a created color using a predetermined algorithm, instead of a natural color in nature. For example, where the 3D engine determines a color of a pixel as red to display a portion of the 3D object, a color tone of the red pixel may be exceedingly sharp as compared to that of the natural color. In this case, a user may feel uncomfortable while viewing the 3D image or viewing pleasure is lessened.

Also, a particular color that is included in the 3D image may be taboo in a particular cultural area or a country. Where a subtitle displayed on a screen is represented as the 3D object, a user with color blindness or partial color blindness incapable of recognizing a particular color may not recognize information displayed on the screen.

Accordingly, there is a need for an apparatus and/or method that converts a color of a 3D object displayed on a display to display the color that is more comfortable to a viewer.

SUMMARY

In one general aspect, there is provided an apparatus and method for converting a color of a three dimensional (3D) image of an image display device based on a user preference color.

In another general aspect, there is provided an apparatus and method for selectively converting a color of a 3D image of an image display device based on a user preference color, only with respect to a 3D object where the 3D image is mixed with the 3D object and a two dimensional (2D) image.

In still another general aspect, an apparatus for converting a color of an image includes an object region determination unit to determine a 3D object display region in an input image, a color gamut determination unit to determine whether a color of a pixel that constitutes the 3D object display region is included in a predetermined color gamut, a user preference information receiver to receive user preference information corresponding to the input image, and a color converter to convert the color of a pixel to an output color based on the user preference information. The color converter may convert the color of a pixel to the output color in response to the color of a pixel being included in the color gamut.

In yet another general aspect, a method of converting a color of an image includes determining a 3D object display region in an input image, determining whether a color of a pixel that constitutes the 3D object display region is included in a predetermined color gamut, receiving user preference information corresponding to the input image, and converting the color of a pixel to an output color based on the user preference information in response to the color of a pixel being included in the color gamut.

Other features will become apparent to those skilled in the art from the following detailed description, which, taken in conjunction with the attached drawings, discloses embodiments of the invention.

BRIEF DESCRIPTION OF THE DRAWINGS

Throughout the drawings and the detailed description, the same drawing reference numerals will be understood to refer to the same elements, features, and structures.

DETAILED DESCRIPTION

The following detailed description is provided to assist the reader in gaining a comprehensive understanding of the methods, apparatuses and/or systems described herein. According, various changes, modifications, and equivalents of the systems, apparatuses and/or methods described herein will be suggested to those of ordinary skill in the art. Also, description of well-known functions and constructions are omitted to increase clarity and conciseness.

Figure 1:
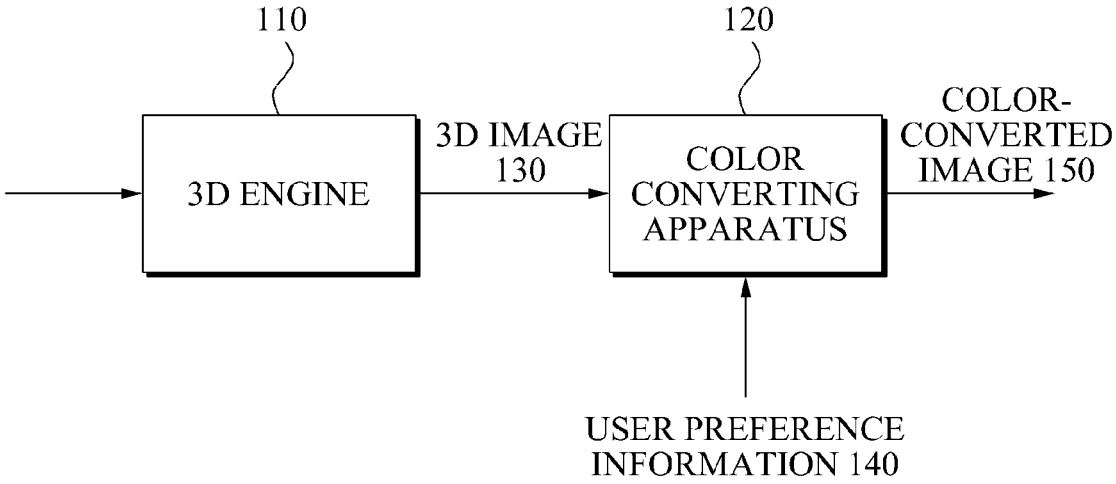
FIG. 1 is a block diagram illustrating a method of converting a color of a three dimensional (3D) image.

FIG. 1 illustrates a method of converting a color of a three dimensional (3D) image. Hereinafter, the technology of converting the color of the 3D image will be described in detail with reference to FIG. 1.

A 3D engine 110 creates a 3D image from image data and the like. The 3D image created by the 3D engine 110 may be, for example, a still image or a moving picture. In the case of the moving picture, a plurality of still images may be consecutively displayed on an image display device. Therefore, the technology that is applied to the still image may be applicable to the moving picture using the same or equivalent scheme.

The 3D engine 110 may include 3D image creating apparatuses for displaying a 3D object on a display in a game, an animation, a movie, and the like.

The color converting apparatus 120 receives the 3D image created by the 3D engine 110. The 3D image may consist of a plurality of pixels. The color converting apparatus 120 may convert the color of a pixel that constitutes the 3D object and thereby convert the color of the 3D object of the 3D image.

The color converting apparatus 120 receives user preference information 140 associated with a user viewing the 3D image, and creates a color-converted image 150 by converting the color of a pixel that constitutes the 3D object, based on the user preference information 140.

Figure 2:
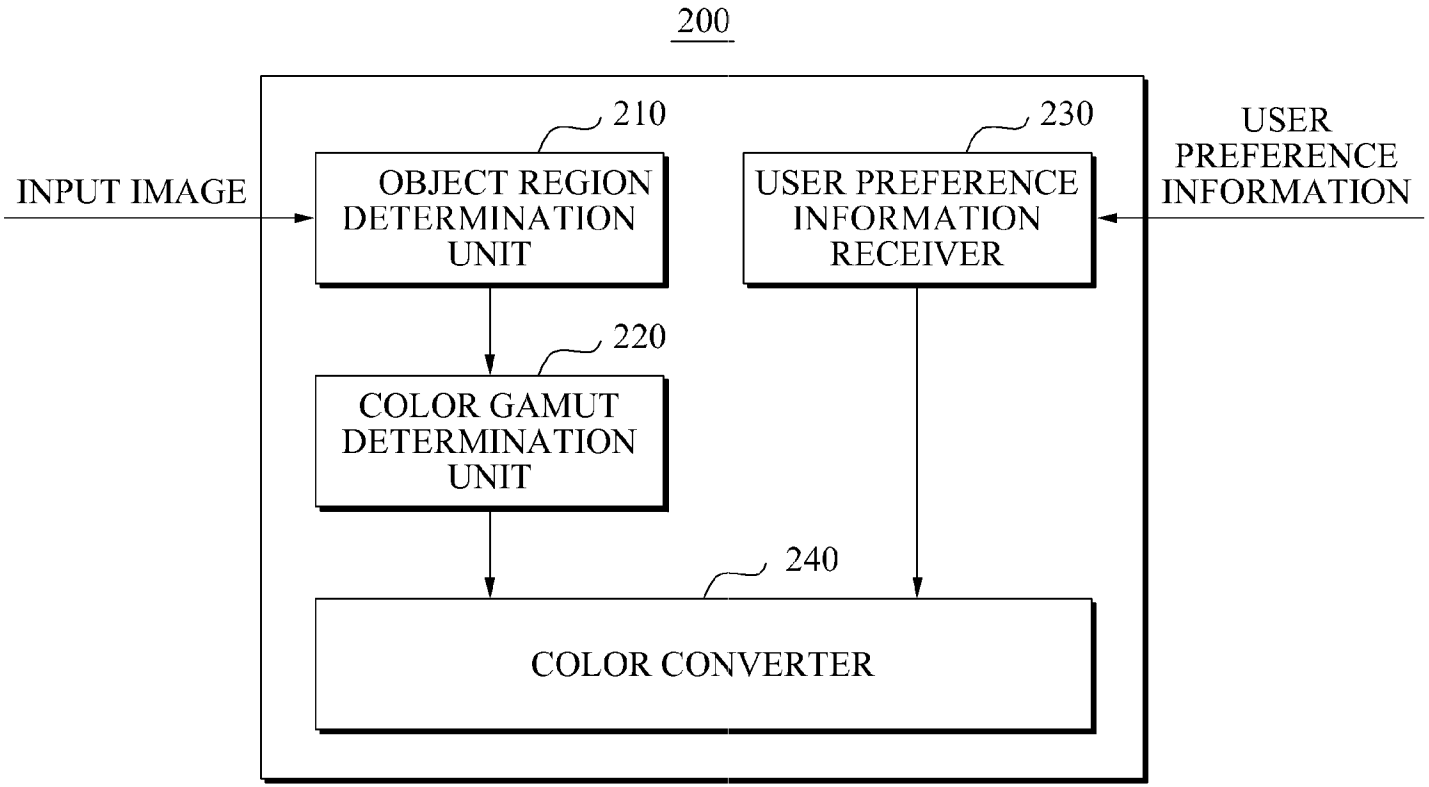
FIG. 2 is a block diagram illustrating a apparatus for converting a color of a 3D image.

FIG. 2 illustrates a apparatus 200 for converting a color of a 3D image. Hereinafter, the apparatus 200 will be described in detail with reference to FIG. 2. The apparatus 200 includes an object region determination unit 210, a color gamut determination unit 220, a user preference information receiver 230, and a color converter 240.

The object region determination unit 210 determines a 3D object display region in an input image. For example, the input image may consist of only a 3D object. As another example, the input image may consist of a two dimensional (2D) image and the 3D image, in which case, it may be ineffective to convert a color with respect to all pixels that constitute the input image. Therefore, the color conversion may be performed with respect to only a pixel that constitutes the 3D object display region of the input image.

The color gamut determination unit 220 determines whether a color of a pixel that constitutes the 3D object display region is included in a predetermined color gamut. The predetermined color gamut may be determined based on user preference information associated with the input image. As a non-limiting illustration, the color gamut determination unit 220 may set the color gamut to a red color section or a green color section.

The user preference information receiver 230 receives the user preference information corresponding to the input image.

Where the color of a pixel is included in the predetermined color gamut, the color converter 240 may convert the color of a pixel that constitutes the 3D object display region to an output color based on the user preference information.

According to an aspect, the user preference information receiver 230 may receive regional information associated with the input image as the user preference information. For example, each input image may include different regional information depending on a region that sells media containing the corresponding input image. For example, a region code used in a digital video display (DVD) and the like may be used as the regional information associated with the input image.

According to the regional information of the input image, the color converter 240 may convert, for example, a skin tone of a character that appears in an input image of media being sold in Asian regions where Asians are in the vast majority to a skin tone of Asians. Also, the color converter 240 may convert, a skin tone of a character that appears in an input image of media being sold in Europe and the like where Caucasians are in the vast majority to a skin tone of Caucasians.

According to another aspect, the user preference information receiver 230 may directly receive regional information corresponding to the input image from a user. Also, the user preference information receiver 230 may include a controller to enable the user to directly perform manipulation and enter data. The user may manipulate the controller and directly input the regional information corresponding to the input image.

According to another aspect, the user preference information receiver 230 may receive language information associated with the input image as the user preference information. The language information associated with the input image may be interpreted as information that is selected to display a subtitle and the like in the input image. For example, subtitle selection information used in a DVD and the like may be received as the language information associated with the input image. Where the language information associated with the input image is Korean, Japanese, and Chinese, the color converter 240 may convert a skin tone of a character to the skin tone of Asians.

According to another aspect, the color gamut may include at least one color section. The apparatus 200 may further include a lookup table that includes a combination of the at least one color section and at least one candidate output color corresponding to each color section. The apparatus 200 may further include a memory (not shown). The lookup table may be stored in the memory.) Where the color of a pixel that constitutes the 3D object display region is included in one of the at least one color section, the color converter 240 may determine an output color from the at least one candidate output color corresponding to the color section, based on the received user preference information.

For example, the predetermined color gamut may include at least one color section that includes a skin tone of a character. Where the pixel that constitutes the 3D object display region represents the skin tone of the character, the color converter 240 may determine the output color of a pixel from candidate output colors corresponding to the color section that includes the skin tone of the character. The candidate output colors corresponding to the color section including the skin tone of the character may be values to represent the skin tone of Asians, the skin tone of blacks, the skin tone of Caucasians, and the like.

According to another aspect, the predetermined color gamut may include at least one color section. The user preference information receiver 230 may receive an output color corresponding to each color section from the user. Where a color of a pixel that constitutes the 3D object display region is included in one of the at least one color section, the color converter 240 converts the color of a pixel to the output color. The output color of a pixels is determined as the output color corresponding to the color section that includes the color of a pixel among the at least one output color received by the user preference information receiver 230. The color included in each color section is converted to a color selected by the user.

For example, where the 3D object is dark blue, a pixel that constitutes the 3D object displayed in the 3D image input into the apparatus 200 is represented as dark blue. However, the user viewing the 3D image may feel uncomfortable while viewing the dark blue displayed in a display device. In this case, where the color of a pixel is dark blue, the user may enter user preference information to convert the dark blue to light blue.

In the 3D image, where the color of a pixel that constitutes the 3D object display region is dark blue, the color converting apparatus may convert the color of a pixel from dark blue to light blue to allow the user readily view the 3D image.

According to another aspect, a user viewing the 3D image may be color blind or partially color blind and thus may not recognize a particular color. The user preference information receiver 230 may receive as the user preference information, information with respect to the color blindness or the partial color blindness and/or information about a color that the user may not recognize. Where the color of a pixel that constitutes the 3D object display region is a color that the user may not recognize, based on the user preference information, the color converter 240 may convert the color of a pixel to a color that the user may recognize.

Figure 3:
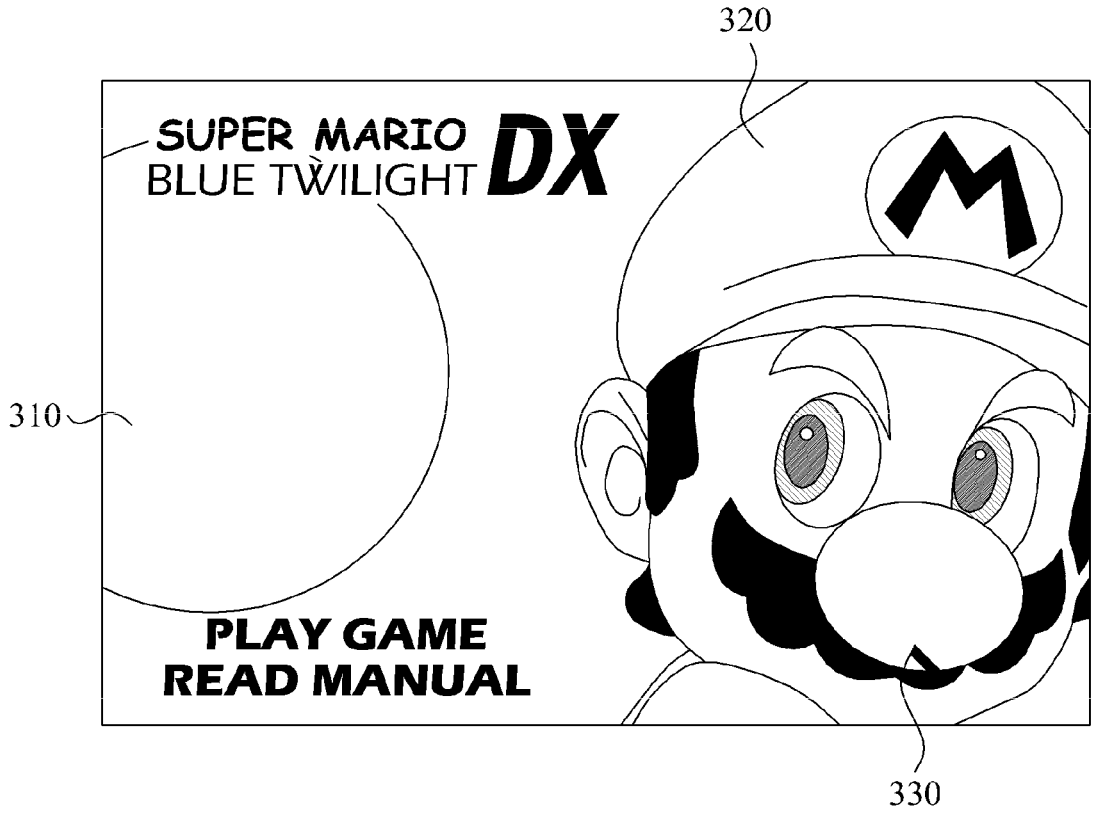
FIG. 3 is a figure illustrating a method of determining a 3D image display region.

FIG. 3 illustrates a method of determining a 3D image display region. Hereinafter, the concept of determining the 3D image display region will be described in detail with reference to FIG. 3.

FIG. 3 illustrates an example of the 3D image input into an apparatus for converting the color of the 3D image according to embodiment. In the 3D image of FIG. 3, a background portion 310 is a 2D image, whereas a cap portion 320 of a character and a skin portion 330 of the character are 3D objects. As illustrated in FIG. 3, a scheme of using the 3D object for the character and the like in the 3D image and using the 2D image for the background portion 310 and thereby mixing the 2D image and the 3D image may be used in a search engine and the like.

The 2D image used in the background portion 310 may be an image edited from a photographed picture and the like, of a natural environment, a landscape, and the like. Therefore, there may not be a need for converting the 2D image based on a user preference, for viewing the 3D image mixed with such 2D image.

However, the cap portion 320 or the skin portion 330 of the character is a 3D object. Therefore, some users viewing the 3D image with the 3D object may feel uncomfortable while viewing the cap or the skin tone displayed in a particular color.

According to an aspect, the apparatus 200 may convert a color of a pixel that constitutes the cap portion 320 of the character that is displayed using, for example, dark red in the 3D image created by the 3D engine to, for example, light red or blue based on user preference information.

According to another aspect, the apparatus 200 may convert the skin portion 330 of the character displayed in the skin tone of, for example, Caucasians in the 3D image created by the 3D engine to, for example, the skin tone of Asians or the skin tone of blacks based on user preference information.

Figure 4:
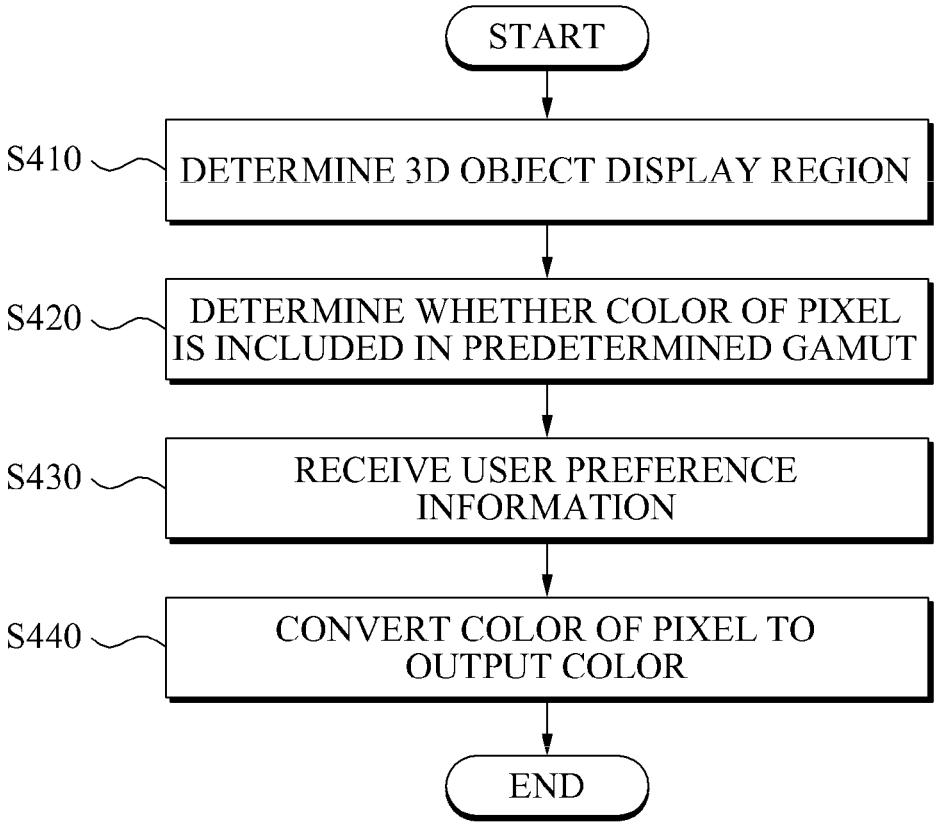
FIG. 4 is a flowchart illustrating an exemplary a method of converting a color of a 3D image.

FIG. 4 illustrates a method of converting a color of a 3D image. Hereinafter, the method of converting the color of the 3D image will be described in detail with reference to FIG. 4.

In operation S410, a 3D object display region in an input image is determined. The entire input image may consist of a 3D object. In another case, the input image may comprise a 2D image and a 3D object. For example, a game engine generally uses a 2D image for the background and uses a 3D image for an image of a character. In this case, it may be ineffective to convert a color with respect to all pixels that constitute the input image.

In operation S420, where the 3D image is included in the input image, it is determined whether a color of a pixel that constitutes a 3D object display region is included in a predetermined color gamut. According to an aspect, the color gamut may be determined based on user preference information corresponding to the input image. Specifically, operation S420 may further include receiving user preference information about the predetermined color gamut. Based on the received user preference information, the color gamut may be set to, for example, a red color section or a green color section.

In operation S430, user preference information corresponding to the input image is received.

According to an aspect, regional information associated with the input image may be received as the user preference information in operation S420.

According to another aspect, language information associated with the input image may be received as the user preference information in operation S420.

According to still another aspect, information regarding the color blindness or the partial color blindness of the user may be received as the user preference information in operation S420.

Where the color of a pixel is included in the color gamut in operation S420, the color of a pixel is converted to an output color based on the user preference information received in operation S430.

Accordingly, the color of a pixel that constitutes the 3D object display region is converted to the output color based on the user preference information in operation S440.

According to an aspect, the predetermined color gamut includes at least one color section. The method may further include storing and maintaining a lookup table in a memory (not shown). The lookup table may include a combination of the at least one color section and at least one candidate output color corresponding to each color section. Where the color of a pixel that constitutes the 3D object display region is included in one of the at least one color section, the output color may be determined from the at least one candidate output color corresponding to the color section, based on the received user preference information.

According to another aspect, the color gamut may include at least one color section. For example, in operation S430, an output color corresponding to each color section may be received from the user. Where the color of a pixel that constitutes the 3D object display region is included in one of the at least one color section, the color of a pixel may be converted to the output color in operation S440. The output color of a pixel is determined as the output color corresponding to the color section that includes the color of a pixel among the at least one output color that is received in operation S430. Therefore, the color that is included in each color section is converted to a color selected by the user.

The configuration of the apparatus 200 converting the color of the 3D image shown in FIG. 2 may be applicable to the configuration of that in the method of converting the color of the 3D image of FIG. 4.

The above-described methods including the 3D image color converting method may be recorded, stored or fixed in one or more computer-readable media that includes program instructions to be implemented by a computer to execute or perform the program instructions. The media may also include, alone or in combination with the program instructions, data files, data structures, and the like. Examples of computer-readable media include magnetic media such as hard disks, floppy disks, and magnetic tape; optical media such as CD ROM disks and DVD; magneto-optical media such as optical disks; and hardware devices that are specially configured to store and perform program instructions, such as read-only memory (ROM), random access memory (RAM), flash memory, and the like.

The media may also be a transmission medium such as optical or metallic lines, wave guides, and the like including a carrier wave transmitting signals specifying the program instructions, data structures, and the like. Examples of program instructions include both machine code, such as produced by a compiler, and files containing higher level code that may be executed by the computer using an interpreter. The described hardware devices may be configured to act as one or more software modules in order to perform the operations described above.

A number of embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. An apparatus for converting a color of an input image having electronic image data, the apparatus comprising:

an object region determination unit configured to determine a 3D object display region in the input image having at least one colored pixel defined in a color space;

a color gamut determination unit configured to determine whether the color of the at least one colored pixel that constitutes the 3D object display region is included in a predetermined color gamut within the color space;

a user preference information receiver configured to receive user preference information corresponding to the input image; and a color converter configured to automatically convert the color of the at least one colored pixel to an output color based on the user preference information when the color of the at least one colored pixel is included in the predetermined color gamut.

2. The apparatus of claim 1, wherein:

the color gamut comprises at least one color section, the apparatus further comprises a memory configured to store a combination of the at least one color section and at least one candidate output color corresponding to each color section, and the color converter is configured to select the output color from the at least one candidate output color based on the received user preference information.

3. The apparatus of claim 2, wherein the user preference information comprises regional information, language information, or both associated with the color of the at least one colored pixel of the input image.

4. The apparatus of claim 1, wherein:

the color gamut includes at least one color section, the user preference information receiver is configured to receive from a user an output color corresponding to each color section, and the color converter is configured to convert the color of the at least one colored pixel to the corresponding output color received from the user.

5. The apparatus of claim 1, wherein the color of the at least one colored pixel is a color that the user cannot ordinary recognize, and based on the user preference information, the color converter is configured to convert the color of the at least one colored pixel to a color that the user can recognize.

6. The apparatus of claim 1, wherein the at least one colored pixel corresponds to a skin tone.

7. The apparatus of claim 1, wherein the input image comprises a still image or a moving picture image.

8. The apparatus of claim 1, wherein the predetermined color gamut is based on user-preference information.

9. A method of converting a color of an input image having electronic image data, the method comprising:

determining a 3D object display region in the input image having at least one colored pixel defined in a color space;

determining whether the color of the at least one colored pixel that constitutes the 3D object display region is included in a predetermined color gamut within the color space;

receiving user preference information corresponding to the input image; and automatically converting the color of the at least one colored pixel to an output color based on the user preference information when the color of the at least one colored pixel is included in the color gamut.

10. The method of claim 9, wherein:

the color gamut comprises at least one color section, the method further comprises accessing a memory storing a combination of the at least one color section and at least one candidate output color corresponding to each color section, and the converting of the color of the at least one colored pixel comprises selecting the output color from the at least one candidate output color based on the received user preference information.

11. The method of claim 10, wherein the user preference information comprises regional information, language information, or both associated with the color of the at least one colored pixel of the input image.

12. The method of claim 9, wherein:

the color gamut includes at least one color section, the receiving of the user preference information comprises receiving from a user an output color corresponding to each color section, and the converting of the color of the at least one colored pixel comprises converting the color of the at least one colored pixel to the corresponding output color received from the user.

13. The method of claim 9, wherein the method is executed by a hardware apparatus.

14. The method of claim 9, wherein the color of the at least one colored pixel is a color that the user cannot ordinary recognize, and based on the user preference information, the color of the at least one colored pixel is converted to a color that the user can recognize.

15. The method of claim 9, wherein the at least one colored pixel corresponds to a skin tone.

16. The method of claim 9, wherein the input image comprises a still image or a moving picture image.

17. The method of claim 9, wherein the predetermined color gamut is based on user-preference information.

18. A non-transitory computer-readable storage medium storing a program to convert a color of an input image having electronic image data, the medium comprising instructions to cause a computer to:

determine a 3D object display region in the input image having at least one colored pixel defined in a color space;

determine whether the color of the at least one colored pixel that constitutes the 3D object display region is included in a predetermined color gamut within the color space;

receive user preference information corresponding to the input image; and automatically convert the color of the at least one colored pixel to an output color based on the user preference information when the color of the at least one colored pixel is included in the color gamut.

19. The medium of claim 18, wherein the predetermined color gamut is based on user-preference information.

* * * * *